US007185974B2

(12) United States Patent
Katayama

(10) Patent No.: US 7,185,974 B2
(45) Date of Patent: Mar. 6, 2007

(54) INK-JET RECORDING APPARATUS

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 10/920,118

(22) Filed: Aug. 16, 2004

(65) Prior Publication Data

US 2005/0041076 A1 Feb. 24, 2005

(30) Foreign Application Priority Data

Aug. 20, 2003 (JP) ..... 2003-296786

(51) Int. Cl.
*B41J 2/175* (2006.01)

(52) U.S. Cl. ..... 347/85; 347/84

(58) Field of Classification Search ..... 347/84–85
See application file for complete search history.

(56) References Cited

U.S. PATENT DOCUMENTS 6,702,427 B2 3/2004 Shimizu et al.
6,877,848 B2 * 4/2005 Shimizu et al. ..... 347/86
2002/0109761 A1 * 8/2002 Shimizu et al. ..... 347/86

FOREIGN PATENT DOCUMENTS

EP 1 232 871 8/2002
JP 2002-307711 10/2002

* cited by examiner

*Primary Examiner*—Stephen Meier
*Assistant Examiner*—Han Samuel Choi
(74) *Attorney, Agent, or Firm*—Day Pitney LLP

(57) ABSTRACT

A bottom of a buffer tank of an ink-jet recording apparatus is formed to have a substantially stepped structure. Ink contained in an ink cartridge is supplied to a lower step side of the stepped structure through an ink-introducing tube. The outside air is introduced into the ink cartridge through an outside air-introducing tube. The height of ink liquid surface is maintained slightly lower than in an upper step surface section of the buffer tank. The water evaporation from the ink liquid surface is suppressed by decreasing the ink liquid surface area while securing a large space on the upper side of the buffer tank. The lowering speed of the height is increased for a certain amount of the ink consumption, rapidly separating the ink liquid surface from the air-introducing tube to suppress erroneous judgment on the ink remaining amount due to fluctuation of the ink liquid surface.

17 Claims, 7 Drawing Sheets

INK-JET RECORDING APPARATUS

BACKGROUND OF THE INVENTION

1. Field of the Invention

The present invention relates to an ink-jet recording apparatus. In particular, the present invention relates to an ink-jet recording apparatus in which an ink introduced from an ink container is stored in a buffer tank, and the ink is supplied from the buffer tank to a printing head.

2. Description of the Related Art

An ink-jet recording apparatus has been hitherto known, in which a buffer tank is provided under an ink cartridge, and the ink cartridge and the buffer tank are communicated with each other via an ink supply passage and an air-introducing passage. Accordingly, the back pressure, which acts on the printing head, is maintained to be constant irrelevant to the remaining amount of the ink in the ink cartridge, and the remaining amount of the ink is detected in the buffer tank.

For example, Japanese Patent Application Laid-open No. 2002-307711 (for example, paragraphs 0055 and 0056, FIG. 3) describes an ink-jet recording apparatus including an air-introducing needle and a hollow ink supply needle composed of a conductive material for making communication between an ink tank (ink cartridge) and a buffer chamber (buffer tank), and a buffer chamber air-communicating section for making communication between the buffer chamber and the outside.

In the case of the ink-jet recording apparatus as described above, a difference is provided between the lower end levels or heights of the ink supply needle and the air-introducing needle. When the ink liquid surface in the buffer chamber is lowered as the ink is consumed by the printing head, then the air is introduced into the ink tank through the air-introducing needle, and the buffer chamber is replenished with the ink contained in the ink tank through the ink supply needle. Accordingly, the height of the ink liquid surface in the buffer chamber is made to be constant, and the back pressure, which acts on the printing head, is maintained to be constant irrelevant to the remaining amount of the ink in the ink tank. Further, the remaining amount of the ink in the buffer chamber can be detected by measuring the change of the electric resistance between the ink supply needle and the air-introducing needle.

In the case of the ink-jet recording apparatus as described above, the buffer chamber is constructed to have a sufficient volume on the assumption that the air in the ink tank may be expanded, for example, by any sudden temperature change, and the ink may be extruded from the ink tank to the buffer chamber. That is, the space having a sufficient volume is formed over the ink liquid surface in the buffer chamber. The ink, which is extruded from the ink tank, is accommodated in the space as described above so that the ink is prevented from any leakage to the outside.

However, in the case of the ink-jet recording apparatus as described above, the space having the large volume is formed over the ink liquid surface in the buffer chamber. Therefore, the following problem has arisen. That is, the area of the ink liquid surface is increased corresponding thereto, and the amount of water evaporation from the ink liquid surface is increased. As a result, the following problem has arisen. That is, for example, when the ink-jet recording apparatus is left to stand for a long term, then the viscosity of the ink is increased, and it is impossible to smoothly perform the operation for supplying the ink to the printing head and the operation for discharging the ink from the nozzles.

When the area of the ink liquid surface is large, the lowering amount of the height of the ink liquid surface is decreased with respect to the consumption of a certain or constant amount of the ink. Therefore, a long period is required for the ink liquid surface to make sufficient separation from the electrode (air-introducing needle). Therefore, the following problem has arisen. That is, any erroneous judgment which shows the presence of the ink is made when the breakage of the electric conduction between the ink supply needle and the air-introducing needle is once detected, and then the electric conduction is made again due to any fluctuation of the ink liquid surface.

SUMMARY OF THE INVENTION

The present invention has been made in order to solve the problems as described above, an object of which is to provide an ink-jet recording apparatus which makes it possible to suppress the evaporation of water by decreasing the area of the ink liquid surface in a buffer tank and which makes it possible to suppress any erroneous judgment on the ink remaining amount caused by the fluctuation of the ink liquid surface, by rapidly separating the ink liquid surface from the electrode.

According to a first aspect of the present invention, there is provided an ink-jet recording apparatus comprising:

a printing head which has an ink discharge port for discharging an ink;

an ink container which stores the ink; and a buffer tank which stores the ink to be supplied to the printing head and which has an outside air-connecting passage for connecting an upper space of the buffer tank to outside air, an ink-introducing tube having an open end in the buffer tank for introducing the ink into the buffer tank from the ink container through the open end, and an outside air-introducing tube having an open end in the buffer tank for introducing the outside air into the ink container through the open end, wherein:

the open end of the outside air-introducing tube is positioned at a height position higher than that of the open end of the ink-introducing tube, and a horizontal cross-sectional area in the buffer tank at the height position of the open end of the outside air-introducing tube is smaller than horizontal cross-sectional areas in the buffer tank at higher positions than the height position.

In the ink-jet recording apparatus of the present invention, the ink liquid surface is formed at the height position or level of the open end of the outside air-introducing tube. The horizontal cross-sectional area in the buffer tank at the height position of the open end of the outside air-introducing tube is smaller than the horizontal cross-sectional areas at higher positions than the height position. Therefore, the area of the ink liquid surface can be decreased, and it is possible to suppress the evaporation of water from the ink liquid surface corresponding thereto. As a result, it is possible to smoothly perform the operation for supplying the ink to the printing head and the operation for discharging the ink from the nozzles by suppressing the increase in the viscosity of the ink. The space having a sufficient volume can be secured over the ink liquid surface while decreasing the area of the ink liquid surface. Therefore, even when the air contained in the ink container is expanded, for example, due to any sudden temperature change, and the ink is extruded into the buffer tank, then the ink can be accommodated in the upper space of the buffer tank, and it is possible to suppress the ink from any overflow to the outside.

Each of the ink-introducing tube and the outside air-introducing tube may be composed of a conductive material, and the ink-introducing tube and the outside air-introducing tube may be arranged to make contact with the ink stored in the buffer tank. Accordingly, it is unnecessary to separately provide any electrode for detecting the remaining amount of the ink in the buffer tank, and the number of parts is reduced. As a result, it is possible to reduce the production cost of the entire ink-jet recording apparatus.

A bottom of the buffer tank may be formed to have a substantially one-stepped structure as viewed in a vertical sectional view, and an upper step of the stepped structure may be located at a position equal to or higher than the height position of the open end of the outside air-introducing tube. In this arrangement, the liquid surface height of the ink contained in the buffer tank can be maintained at a position substantially equal to the position of the upper step of the stepped structure or at a position lower than the above. Therefore, the area of the ink liquid surface can be decreased, and it is possible to suppress the evaporation of water from the ink liquid surface corresponding thereto. As a result, it is possible to suppress the increase in the viscosity of the ink, and it is possible to smoothly perform the operation for supplying the ink to the printing head and the operation for discharging the ink from the nozzles. When the bottom of the buffer tank is formed to have the substantially stepped structure, it is possible to secure the space having a sufficient volume over the ink liquid surface, while decreasing the area of the ink liquid surface. Therefore, even when the air contained in the ink container is expanded, for example, due to any sudden temperature change, and the ink is extruded into the buffer tank, then the ink can be accommodated in the upper space of the buffer tank, and it is possible to suppress the ink from any overflow to the outside. Additionally, it is possible to quicken the lowering speed of the ink liquid surface height with respect to the consumption of a certain amount of the ink by decreasing the area of the ink liquid surface. Therefore, the electric characteristic change can be detected between the ink-introducing tube and the outside air-introducing tube, and it is possible to quickly separate the ink liquid surface from the electrode thereafter. Therefore, it is possible to suppress the inconvenience which would be otherwise caused in which any erroneous judgment showing the presence of ink is made due to the change of the electric characteristic again by the fluctuation of the ink liquid surface.

A surface, which defines the upper step of the stepped structure, may be inclined downwardly toward a lower step of the stepped structure. In this arrangement, for example, even when the ink liquid surface is fluctuated, and the upper surface of the upper step of the stepped structure is covered with the ink, then it is possible to allow the ink to flow downwardly toward the lower step of the stepped structure, i.e., toward the ink-storing section. Thus, it is possible to suppress the ink from remaining on the upper surface of the upper step of the stepped structure. As a result, it is possible to use the ink contained in the buffer tank without any loss, and it is possible to improve the efficiency of use.

At least a part of an upright section for making communication between the upper step and a lower step of the stepped structure may be inclined to have an inclined portion thereof at which the horizontal cross-sectional area in the buffer tank is gradually decreased at downward positions. For example, when the presence or absence of the ink is detected in accordance with the change of the electric characteristic between a pair of electrodes, the ink liquid surface can be quickly separated from the electrode by increasing the amount of downward movement of the ink liquid surface with respect to the consumption of a certain amount of the ink. Therefore, it is possible to further suppress the inconvenience which would be otherwise caused in which any erroneous judgment which shows the presence of the ink is made due to the change of the electric characteristic again by the fluctuation of the ink liquid surface.

The upright section may be formed such that a lower step side of the upright section has a substantially right angle or a steep angle of inclination as compared with an upper step side of the upright section. Accordingly, it is possible to delay the lowering speed of the ink liquid surface when the remaining amount of the ink is decreased, while quickening the lowering speed of the ink liquid surface when the remaining amount of the ink is large. Therefore, for example, when the amount of use of the ink is estimated by using, for example, a soft counter to give any empty alarm after detecting the change of the electric characteristic between the ink-introducing tube and the outside air-introducing tube, it is possible to suppress any excessive downward movement of the ink liquid surface even when the remaining amount of the ink is dispersed due to any estimation error. Therefore, it is possible to previously avoid the occurrence of any discharge failure which would be otherwise caused by the bubbles caught in the printing head.

A space, which is located over a horizontal surface of the open end of the outside air-introducing tube, may have a volume which is not less than 10% of a total volume of the ink container. Therefore, even when the air contained in the ink container is expanded, for example, due to any sudden temperature change, and the ink is extruded into the buffer tank, then the ink can be accommodated in the buffer tank, and it is possible to reliably suppress the ink from any overflow to the outside.

According to a second aspect of the present invention, there is provided an ink-jet recording apparatus comprising:

a printing head which has an ink discharge port for discharging an ink;

an ink container which stores the ink; and a buffer tank which stores the ink to be supplied to the printing head and which has a comparting plate for comparting the buffer tank into a first chamber and a second chamber, an outside air-connecting passage for connecting interior of the buffer tank to outside air, an ink-introducing tube provided penetratingly through the comparting plate for introducing the ink into the buffer tank from the ink container, and an outside air-introducing tube for introducing the outside air introduced into the buffer tank through the outside air-connecting passage into the ink container, wherein:

a communication passage, which makes communication between the first chamber and the second chamber, is formed through the comparting plate, and an open end of the outside air-introducing tube is positioned in the communication passage.

In the ink-jet recording apparatus of the present invention, the interior of the buffer tank is vertically comparted by the comparting plate into the first chamber and the second chamber, and the open end of the outside air-introducing tube, which is disposed in the buffer tank, is arranged in the communication passage for making communication between the first chamber and the second chamber. Therefore, it is possible to maintain the ink liquid surface level in the buffer tank to be within the communication passage. Therefore, the area of the ink liquid surface can be decreased, and it is possible to suppress the evaporation of water from the ink liquid surface. The space (second chamber) having a sufficient volume can be secured under the comparting plate. Therefore, the ink having a sufficient volume can be stored in the second chamber, and it is possible to delay the drying speed with respect to the evaporation of a certain amount of water. As a result, the following effect is obtained. That is, it is possible to smoothly perform the operation for supplying the ink to the printing head and the operation for discharging the ink from the nozzles by suppressing the increase in the viscosity of the ink.

When the interior of the buffer tank is comparted by the comparting plate, the area of the ink liquid surface can be decreased, while the space (first chamber) having a sufficient volume can be secured over the ink liquid surface. Therefore, even when the air contained in the ink container is expanded, for example, due to any sudden temperature change, and the ink is extruded into the buffer tank, then the ink can be accommodated in the first chamber (upper space) in the buffer tank, and it is possible to suppress the ink from any overflow to the outside. When the ink liquid surface in the buffer tank is maintained within the communication passage, then the area of the ink liquid surface can be decreased, and it is possible to quicken the lowering speed of the ink liquid surface level. Therefore, the electric characteristic change can be detected between the ink-introducing tube and the outside air-introducing tube, and the ink liquid surface can be quickly separated from the electrode thereafter. Further, when the ink liquid surface is once lowered down to the second chamber, the inflow of the ink into the communication passage is hardly caused. Therefore, it is possible to suppress the inconvenience which would be otherwise caused in which any erroneous judgment showing the presence of the ink is made due to the change of the electric characteristic again by the fluctuation of the ink liquid surface.

In the ink-jet recording apparatus according to the second aspect, the communication passage may include at least first to third passages, the open end of the outside air-introducing tube may be positioned in the first passage, and the ink-introducing tube may penetrate through the second passage. The third passage is provided penetratingly through the comparting plate. Therefore, when the air in the ink container is expanded or contracted, for example, due to any sudden temperature change, and the ink contained in the buffer tank is increased/decreased, then the ink can be smoothly increased/decreased by the aid of the third passage.

In this arrangement, a cross-sectional area of the third passage may be smaller than cross-sectional areas of the first and second passages, and thus it is possible to minimize the leakage of the ink. In view of the prevention of the evaporation of water contained in the ink and the sensitivity of the detection of the ink level, for example, a cross-sectional area of the first passage may be not more than 10% of an area of the comparting plate.

The comparting plate may be substantially rectangular as viewed in a top view, and the third passage may be provided penetratingly through at least one of four corners of the comparting plate. In this arrangement, for example, even when the ink in the buffer tank is increased/decreased in a state in which the buffer tank is installed in an inclined configuration, it is possible to suppress the remaining of bubbles and the remaining of the ink in one corner in the buffer tank.

A portion of a surface of the comparting plate on a side of the first chamber, which is disposed in the vicinity of a portion in which the communication passage is provided therethrough, may be formed to incline downwardly toward the communication passage. In this arrangement, it is possible to allow the ink to flow downwardly along the inclined portion, and it is possible to suppress the remaining of the ink on the upper surface side of the comparting plate.

A portion of a surface of the comparting plate on a side of the second chamber, which is disposed in the vicinity of a portion in which the communication passage is provided therethrough, may be formed to incline upwardly toward the communication passage. It is possible to suppress the remaining of bubbles on the lower surface side of the comparting plate by moving the bubbles upwardly along the inclined portion.

DESCRIPTION OF THE PREFERRED EMBODIMENTS

Figure 1:
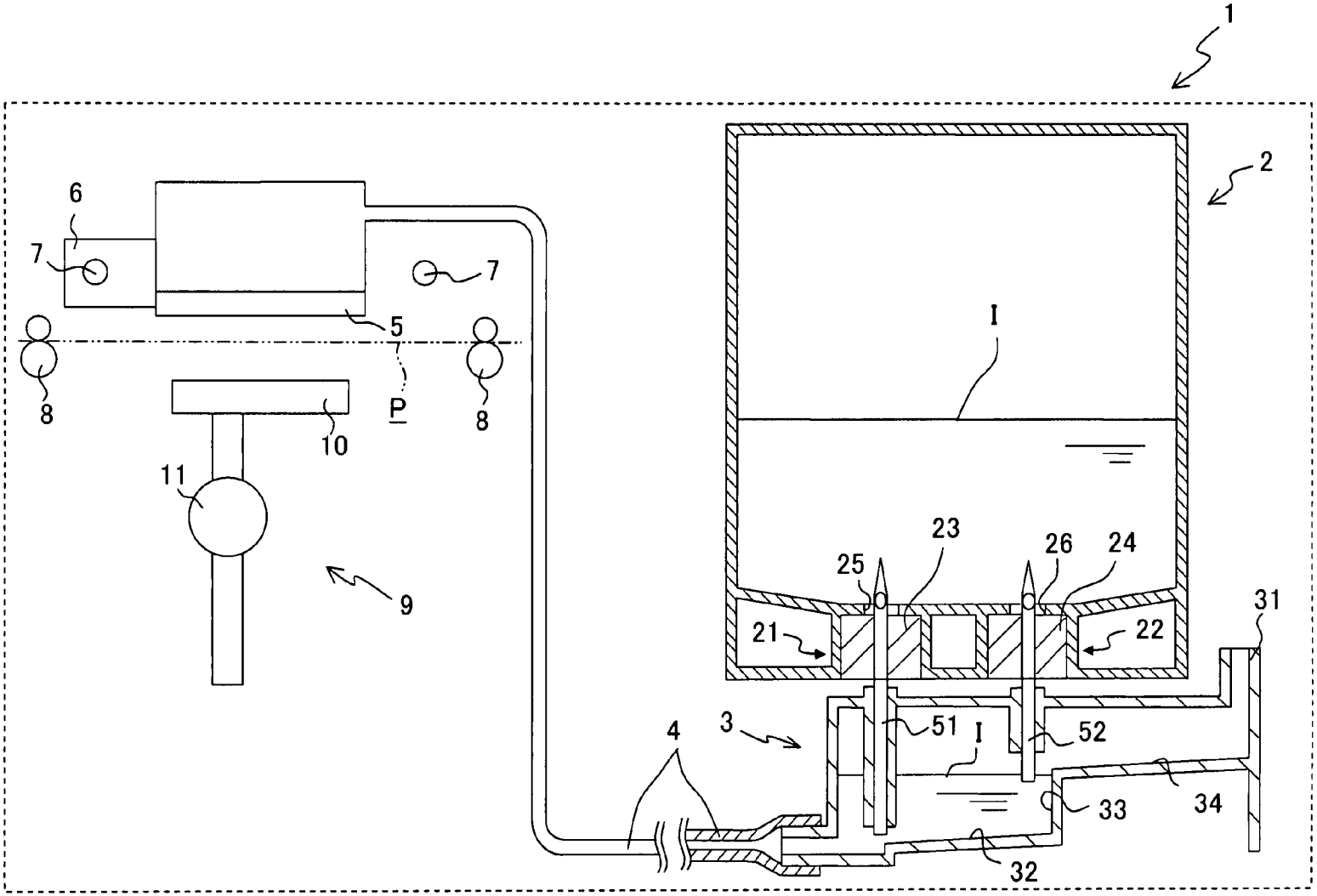
FIG. 1 schematically shows an ink-jet recording apparatus according to a first embodiment of the present invention.

Preferred embodiments of the present invention will be explained below with reference to the accompanying drawings. FIG. 1 schematically shows an ink-jet recording apparatus 1 according to a first embodiment of the present invention.

The ink-jet recording apparatus 1 principally comprises a plurality of ink containers, i.e., ink cartridges 2 which are charged with four color inks of cyan, magenta, yellow, and black respectively, buffer tanks 3 to which the ink cartridges 2 are detachably installed and in which the inks supplied from the ink cartridges 2 through ink-introducing tubes 51 are stored, a printing head 5 which discharges the ink supplied from the buffer tank 3 through a supply tube 4 toward printing paper P, a carriage 6 on which the printing head 5 is carried and which makes reciprocating motion in the linear direction, a carriage shaft 7 which serves as a guide when the carriage 6 makes the reciprocating motion, a transport mechanism 8 which transports the printing paper P, and a purge unit 9.

The ink cartridge 2 has, at its bottom, two insert sections 21, 22 for receiving the ink-introducing tube 51 and an outside air-introducing tube 52. Plugs 23, 24, which provide a tightly sealed state in the ink cartridge 2, are fitted in compressed states into the respective insert sections 21, 22. The respective plugs 23, 24 make contact with the ink I by the aid of extraction ports 25, 26 which are open at the bottom of the ink cartridge 2.

The ink-introducing tube 51 and the outside air-introducing tube 52 are arranged to protrude substantially in parallel to one another through the ceiling wall in the buffer tank 3. The hollow needle-shape ink-introducing tube 51 extracts the ink I stored in the ink cartridge 2, and supplies the ink I to the printing head 5. The hollow needle-shaped outside air-introducing tube 52 introduces the outside air into the ink cartridge 2 as the ink I is extracted through the ink-introducing tube 51. The lower ends of the ink-introducing tube 51 and the outside air-introducing tube 52 make contact with the ink stored in the buffer tank 3 respectively. Each of the ink-introducing tube 51 and the outside air-introducing tube 52 is composed of a conductive material, which also serves as an electrode for detecting the residual amount of the ink.

When the ink cartridge 2 is installed to the buffer tank 3, then the tips of the ink-introducing tube 51 and the outside air-introducing tube 52 pierce the plugs 23, 24 respectively, and are advanced to make contact with the ink I. Each of the plugs 23, 24 is composed of an elastic material such as butyl rubber. The ink-introducing tube 51 and the outside air-introducing tube 52 are capable of piercing the plugs 23, 24. Further, the plugs 23, 24 are fitted into the insert sections 21, 22 in the compressed states as described above. Therefore, the tightly sealed or closed state is restored in accordance with the elastic function even after being pulled out.

An outside air-connecting passage 31, which has an open upper end, is provided at an upper portion of the buffer tank 3. The upper space of the buffer tank 3 is connected to the outside air via the outside air-connecting passage 31. The lower end opening of the outside air-introducing tube 52 is open at a position which is higher than that of the lower end opening of the ink-introducing tube 51. Detailed structure of the buffer tank 3 will be described later on.

As shown in FIG. 1, when the ink I is discharged from the printing head 5 to the printing paper P after the ink cartridge 2 is installed to the buffer tank 3, the ink I, which corresponds to the discharged amount, is supplied from the buffer tank 3 to the printing head 5 through the supply tube 4. As the ink I is supplied, the liquid surface level or height of the ink in the buffer tank 3 is lowered, and the lower end opening of the outside air-introducing tube 52 is exposed to the upper space of the buffer tank 3. As a result, the outside air is introduced into the ink cartridge 2 from the outside air-introducing tube 52 through the outside air-connecting passage 31 and the upper space of the buffer tank 3.

When the outside air is introduced into the ink cartridge 2, the ink contained in the ink cartridge 2 is introduced into the buffer tank 3 through the ink-introducing tube 51. When the ink is introduced into the buffer tank 3, then the liquid surface level of the ink is raised again in the buffer tank 3, and the lower end opening of the outside air-introducing tube 52 is immersed in the ink. As a result, the liquid surface level of the ink I in the buffer tank 3 is maintained in the vicinity of the level of the lower end opening of the outside air-introducing tube 52. In this steady state, the ink-introducing tube 51 and the outside air-introducing tube 52 make contact with the ink I respectively.

After that, when all of the ink I contained in the ink cartridge 2 is consumed, the ink I in the buffer tank 3 is subsequently consumed. As the liquid surface level of the ink I is lowered, a state is given, in which the outside air-introducing tube 52 makes no contact with the ink I. As shown in FIG. 1, the upper end opening of the ink-introducing tube 51 is open in the extraction port 25 provided at the bottom of the ink cartridge 2. Therefore, the ink I contained in the ink cartridge 2 can be almost exhausted.

A plurality of nozzles are provided for the printing head 5. The ink I, which is stored in the buffer tank 3, is discharged from the nozzles. During the printing operation, the ink is discharged while the carriage 6 makes the reciprocating motion to perform the printing on the printing paper P.

The purge unit 9 executes the purge process to restore the satisfactory discharge state by sucking, for example, the air (bubbles) and the ink I having high viscosities which closes the nozzles of the printing head 5. The purge unit 9 includes a purge cap 10 which forms the tightly closed space with respect to the ink discharge surface of the printing head 5 by making abutment against the ink discharge surface when the printing head 5 is disposed at the position to execute the purge process which is set to be without the printing range, and a suction pump (PG pump) 11 which sucks the ink. The purge cap 10 is movable in the direction to make abutment and separation with respect to the ink discharge surface.

Figure 2:
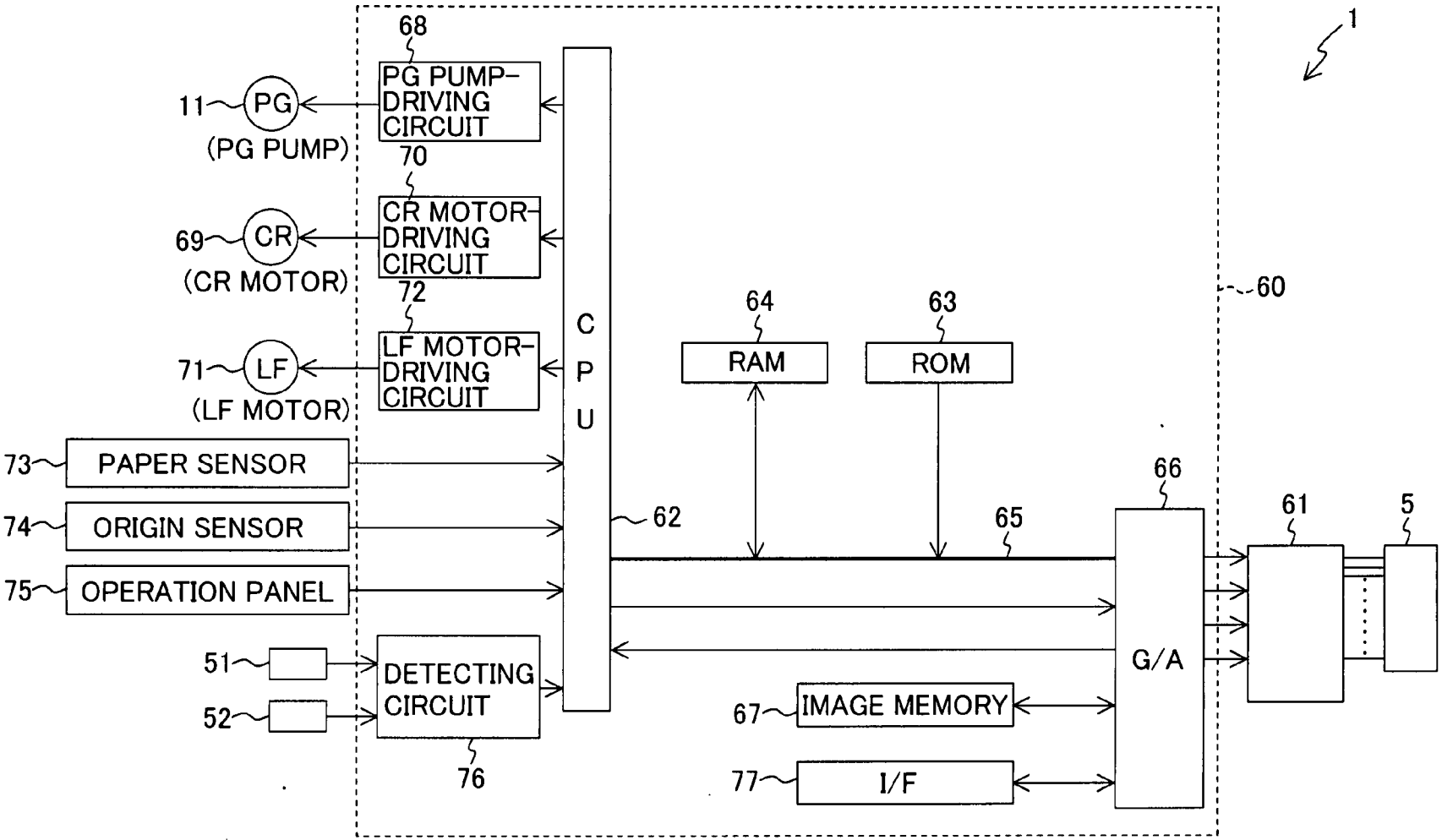
FIG. 2 shows a block diagram illustrating an electric arrangement of the ink-jet recording apparatus.

FIG. 2 shows a block diagram illustrating an electric arrangement of the ink-jet recording apparatus 1. A control unit for controlling the ink-jet recording apparatus 1 includes a main body control board 60 and a carriage board 61 which is carried on the carriage 6. Those carried on the main body control board 60 include a microcomputer (CPU) 62 which is composed of one chip, ROM 63 which stores various control programs to be executed by CPU 62 and fixed value data, RAM 64 which serves as a memory for temporarily storing various data or the like, an image memory 67, and a gate array (G/A) 66.

CPU 62, which serves as a computing unit, executes various processes in accordance with the control programs previously stored in ROM 63. Further, CPU 62 generates a printing timing signal and a reset signal, and transfers the respective signals to G/A 66 as described later on. Those connected to CPU 62 include, for example, a PG pump-driving circuit 68 which drives a PG pump (suction pump) 11 of the purge unit 9, a CR motor-driving circuit 70 which drives a CR motor 69 for reciprocating the carriage 6, an LF motor-driving circuit 72 which operates a transport motor (LF motor) 71 provided in the transport mechanism 8 for transporting the printing paper P, a paper sensor 73 which detects the tip of the printing paper P, an origin sensor 74 which detects the origin position of the carriage 6, an operation panel 75 which has, for example, a display panel for displaying various information and a plurality of operation elements with which the user instructs, for example, the printing, and a detecting circuit 76 which detects an electric characteristic of the ink, for example, a resistance value between the ink-introducing tube 51 as a first electrode and the outside air-introducing tube 52 as a second electrode for judging the near empty respectively. CPU 62 controls the operations of the respective devices which are connected as described above.

G/A 66 outputs the printing data (driving signal) which is used to print the image data on the printing paper on the basis of the printing timing signal transferred from CPU 62 and the image data stored in the image memory 67, a transfer clock which is synchronized with the printing data, a latch signal, a parameter signal which generates a basic printing waveform signal, and a discharge timing signal which is outputted at a constant cycle. The respective signals are transferred to the carriage board 61 on which a head driver is mounted.

G/A 66 stores the image data in the image memory 67, the image data being transferred from an external equipment such as a computer via a centronics interface (I/F) 77. G/A 66 generates a centronics data receiving interrupt signal on the basis of the centronics data transferred, for example, from a host computer via I/F 77, and transfers the signal to CPU 62. The respective signals, which are subjected to the communication between G/A 66 and the carriage board 61, are transferred via a harness cable which connects the both. CPU 62, ROM 63, RAM 64, and G/A 66 described above are connected to one another via a bus line 65.

The carriage board 61 is provided to drive the printing head 5 by using a mounted head driver (driving circuit). The printing head 5 and the head driver are connected to one another by the aid of a flexible wiring board having a copper foil wiring pattern formed on a polyimide film having a thickness of 50 to 150 μm. The head driver is controlled by G/A 66 which is mounted on the main body control board 60, and it applies a driving pulse having a waveform in conformity with the printing mode to the respective driving elements. Accordingly, a predetermined amount of the ink is discharged.

The detecting circuit 76 applies the voltage to the ink-introducing tube 51 and the outside air-introducing tube 52 which are constructed as the electrodes as well. Further, the detecting circuit 76 detects the resistance value between the ink-introducing tube 51 and the outside air-introducing tube 52. The output, which is based on the detected resistance value, is inputted into CPU 62. The residual or remaining amount of the ink in the buffer tank is detected by CPU 62 on the basis of the input value.

That is, the conduction route based on the ink I is formed between the ink-introducing tube 51 and the outside air-introducing tube 52 in the steady state (see FIG. 1). Therefore, a predetermined resistance value (for example, about 10 kΩ to about 20 kΩ) is detected between the ink-introducing tube 51 and the outside air-introducing tube 52. However, when the ink I contained in the buffer tank 3 is consumed, and the residual amount of the ink is at a level lower than that of the outside air-introducing tube 52, then the conduction route based on the ink I is intercepted or blocked. Therefore, the resistance value becomes an extremely large value (for example, about 10 MΩ to about 20 MΩ). CPU 62 detects the residual amount of the ink in the buffer tank 3 on the basis of the change in the resistance value.

Figure 3:
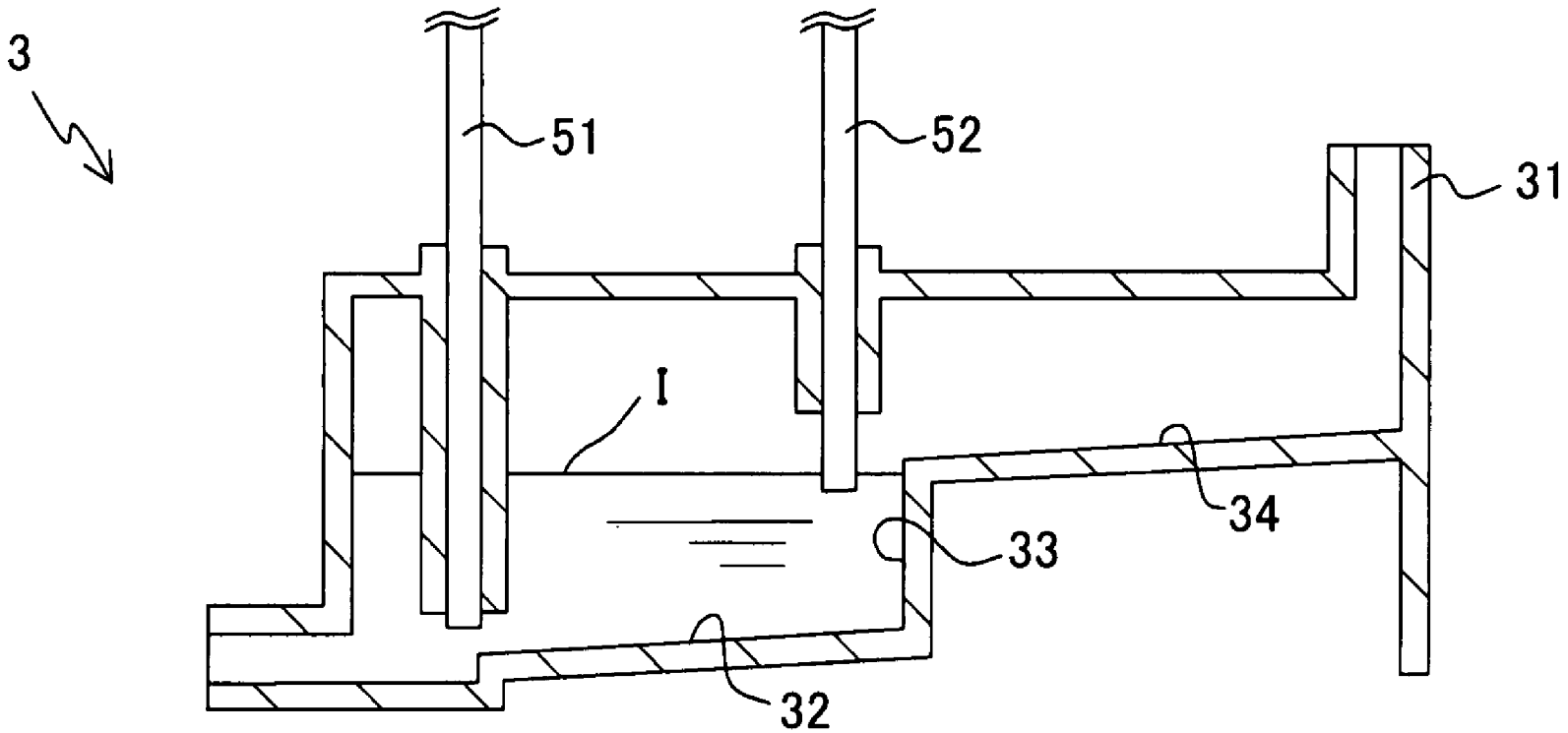
FIG. 3 shows a vertical sectional view illustrating a buffer tank.

Next, the structure of the buffer tank 3 will be explained in detail with reference to FIG. 3. FIG. 3 shows a vertical sectional view illustrating the buffer tank 3. In FIG. 3, the components are illustrated, while, for example, the ink cartridge 2 and the supply tube 4 are omitted.

The buffer tank 3 includes a lower step surface section 32, an upright surface section 33, and an upper step surface section 34. As shown in FIG. 3, the bottom of the buffer tank 3 is formed to have a substantially one-stepped shape with the respective members 32 to 34. The two introducing tubes 51, 52 are disposed at positions at which they are opposed to the lower step surface section 32. The supply tube 4 is connected to the bottom of the lower step surface section 32 (see FIG. 1).

The height of the upper step surface section 34 is substantially the same as the height position of the lower end opening of the outside air-introducing tube 52. Preferably, the upper step surface section 34 is disposed at a position slightly higher than the above. For example, the height of the upper step surface section 34 is located at a position higher than the height position of the lower end opening by 1 mm to 5 mm. Therefore, in the steady state shown in FIG. 3, the liquid surface level of the ink I contained in the buffer tank 3 can be maintained to be substantially the same as that of the upper step surface section 34 or to be at a position slightly lower than the above. If the height of the upper step surface section 34 is excessively higher than that of the lower end opening of the outside air-introducing tube 52, then the volume of the upper step surface section 34 is decreased, and the function as the buffer tank is deteriorated, which is not desirable.

Therefore, the horizontal sectional area of the buffer tank 3 at the height substantially of the lower end opening of the outside air-introducing tube 52, is smaller than the horizontal sectional area in the space disposed over the upper step surface section 34. When the ink I is stored on the lower step side of the step section, the liquid surface area of the ink I can be decreased to suppress the evaporation of water from the ink liquid surface to an extent corresponding thereto. As a result, for example, even when the ink-jet recording apparatus 1 is left to stand for a long period of time, and no printing operation is performed, then the viscosity of the ink I can be suppressed from being increased, making it possible to smoothly perform the operation for supplying the ink to the printing head 5 and the operation for discharging the ink from the nozzles.

Further, it is possible to form a space (hereinafter referred to as "upper space") having a sufficient volume over the upper step surface section 34 while suppressing the height dimension of the buffer tank 3 to be low. Therefore, even when the air contained in the ink cartridge 2 is expanded, for example, by any sudden change in the ambient temperature, and the ink I is extruded into the buffer tank 3, then the ink I can be accommodated in the upper space in the buffer tank 3, and it is possible to suppress the overflow of the ink I from the outside air-connecting passage 31 to the outside.

As for the volume of the upper space of the buffer tank 3, it is preferable to secure a volume of not less than about 5% of the total volume of the ink cartridge 2 in order that all of the ink I inflowing from the ink cartridge 2 is accommodated and the ink I is prevented from any outflow or overflow to the outside. It is more preferable to secure a volume of not less than about 10%. In this embodiment, the volume of the upper space is set to be about 13%. An explanation will now be made with reference to FIG. 4 about the maximum inflow amount of the ink I extruded from the ink cartridge 2 to flow into the buffer tank 3.

Figure 4A:
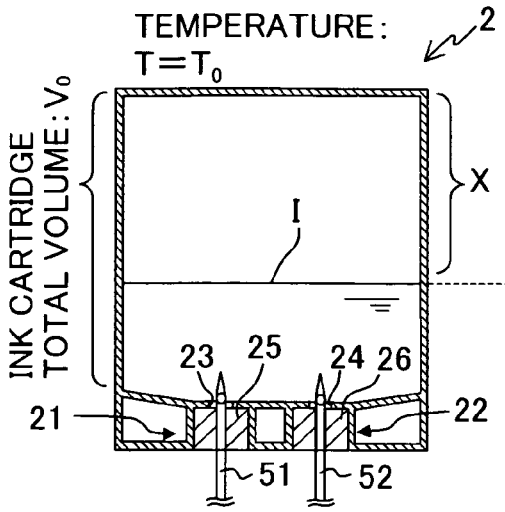
FIGS. 4A and 4B schematically show situations in which the air contained in an ink cartridge is expanded depending on the change in ambient temperature.
Figure 4B:
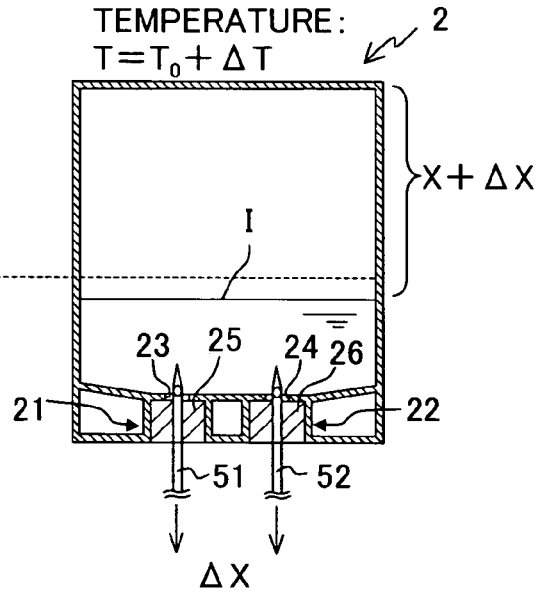

FIGS. 4A and 4B schematically show situations in which the air contained in the ink cartridge 2 is expanded by the change in ambient temperature. For example, when the ambient temperature T, in which the ink cartridge 2 having a total volume V0 (initial air amount of "X" and residual amount of ink I of "V0−X") is placed, is raised from "T0 (see FIG. 4A)" to "T0+ΔT (see FIG. 4B)" by "ΔT", the air contained in the ink cartridge 2 is expanded by "ΔX" as shown in FIG. 4B. The ink I, which corresponds to the expansion amount ("ΔX"), is extruded from the ink cartridge 2, and the ink I flows into the buffer tank 3 through the ink-introducing tube 51 and the outside air-introducing tube 52.

Figure 4C:
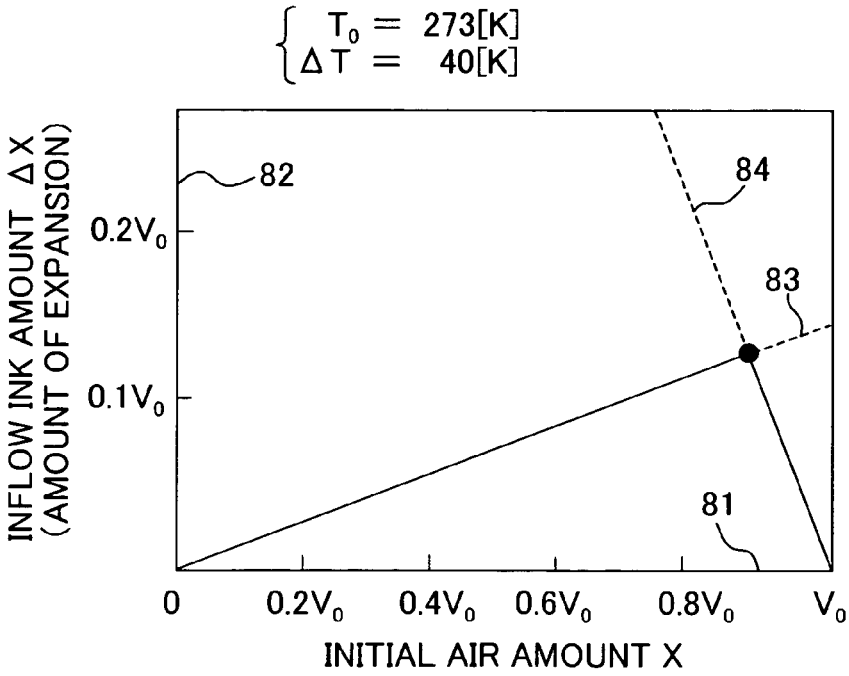
FIG. 4C shows a relationship between the initial air amount and the inflow ink amount.

FIG. 4C shows the relationship between the initial air amount X contained in the ink cartridge 2 and the inflow ink amount ΔX into the buffer tank 3, wherein the horizontal axis 81 indicates the initial air amount x which constitutes a part of the total volume V0 of the ink cartridge 2, and the vertical axis 82 indicates the inflow ink amount ΔX which flows from the ink cartridge 2 into the buffer tank 3.

Assuming that the air contained in the ink cartridge 2 is the ideal gas, it is possible to apply the equation of state of the ideal gas (PV=nRT) to the state of the gas contained in the ink cartridge 2. In the equation, P represents the pressure, V represents the volume, n represents the amount of substance, R represents the gas constant, and T represents the absolute temperature. According to the equation of state, the respective states shown in FIGS. 4A and 4B can be expressed by two equations of $PX=nRT0$ and $P(X+\Delta X)=nR(T0+\Delta T)$. When the two equations are solved as simultaneous equations, it is possible to derive the relationship of $\Delta X=(\Delta T/T0)X$ (hereinafter referred to as "first equation").

The first equation is depicted in the graph as the straight line 83 shown in FIG. 4C. However, the straight line 83 indicates the first equation: $\Delta X=0.147X$ obtained when the ambient temperature T, in which the ink cartridge 2 is placed, is raised from T0=273 [K] (0 degree centigrade) by $\Delta T=40$ [K]. According to the straight line 83, for example, the following fact is appreciated. That is, when the ambient temperature T is raised by about 40 [K] when the initial air amount X in the ink cartridge 2 is, for example, "0.6V0" (i.e., in a state in which the air occupies about 60% of the total volume V0 of the ink cartridge 2 and the ink I occupies the remainder of about 40% as shown in FIG. 4A), the inflow ink amount $\Delta X$ is "0.88V0". The ink I, which is in an amount corresponding to about 8.8% of the total volume V0 of the ink cartridge 2, is extruded from the ink cartridge 2, and the ink I flows into the buffer tank 3.

However, when the residual amount of the ink I contained in the ink cartridge 2 is smaller than the amount of expansion of the air ("$\Delta X$" in FIG. 4B), then all of the ink I is extruded from the ink cartridge 2, and the ink I flows into the buffer tank 3. Therefore, in this case, the residual amount of the ink I in the ink cartridge 2 is the inflow ink amount $\Delta X$. Therefore, it is possible to derive the relationship of $\Delta X=V0-X$ (hereinafter referred to as "second equation"). The second equation is depicted in the graph as the straight line 84 shown in FIG. 4C.

Accordingly, it is possible to obtain the maximum value of the inflow ink amount $\Delta X$ by determining the point of intersection between the first equation and the second equation. In the situation shown in FIG. 4C, when the initial air amount X in the ink cartridge 2 is "0.872V0" (i.e., when the air occupies about 87.2% of the total volume V0 of the ink cartridge 2 and the ink I occupies the remainder of about 12.8%), then all of the ink I contained in the ink cartridge 2 is extruded, and the inflow ink amount $\Delta X$ is the maximum value "0.128V0". Therefore, when the upper space of the buffer tank 3 (see FIG. 3) possesses not less than about 12.8% of the total volume V0 of the ink cartridge 2, then it is possible to accommodate all of the inflowing ink I, and it is possible to prevent the ink I from overflowing to the outside.

The explanation has been made about the case in which the ambient temperature is raised from the initial temperature T0=273 [K] (0 degree centigrade) by $\Delta T=40$ [K]. However, when the ambient temperature is raised from the initial temperature T0=263 [K] (−10 degrees centigrade) and from 303 [K] (30 degrees centigrade) by $\Delta T=40$ [K], the maximum values of the inflow ink amount $\Delta X$ are "0.132V0" and "0.117V0" respectively. When the ambient temperature is raised from the initial temperature T0=273 [K] (0 degree centigrade) by $\Delta T=70$ [K], the maximum value of the inflow ink amount $\Delta X$ is "0.204V0".

An explanation will be made with reference to FIG. 3 again. As described above, the buffer tank 3 has its bottom formed to have the substantially stepped shape, and the ink I can be stored in the lower stepped portion of the stepped section. Therefore, it is possible to quicken the lowering speed of the liquid surface level of the ink I with respect to the consumption of a certain amount of the ink by decreasing the liquid surface area of the ink I. Accordingly, the liquid surface of the ink I in the buffer tank 3 can be rapidly separated from the outside air-introducing tube 52 after all of the ink contained in the ink cartridge 2 is consumed. Therefore, it is possible to suppress the inconvenience which would be otherwise caused, in which the presence of the ink is erroneously judged because the temporary separation of the outside air-introducing tube 52 from the ink liquid surface is detected, and then the ink makes contact with the outside air-introducing tube 52 again due to any fluctuation of the ink liquid surface caused thereafter.

As shown in FIG. 3, the buffer tank 3 has the upper step surface section 34 of the stepped section which is constructed to incline downwardly toward the lower step surface section 32. Therefore, for example, even when the liquid surface of the ink I is fluctuated and the upper step surface section 34 is covered with the ink I, then the ink I is allowed to flow downwardly toward the side of the lower step surface section 32 of the stepped section, i.e., toward the ink storage section, and it is possible to suppress the remaining of the ink on the upper step surface section 34. Thus, it is possible to use the ink I contained in the buffer tank without any loss, and it is possible to improve the efficiency of ink usage.

Next, a second embodiment will be explained with reference to FIG. 5. In the case of the buffer tank 3 of the first embodiment, the upright surface section 33 is constructed in the upstanding manner substantially perpendicularly. On the other hand, in the case of a buffer tank 103 of the second embodiment, a part of the upright surface section 133 is constructed to incline downwardly. The same parts or components as those of the first embodiment described above are designated by the same reference numerals, any explanation of which will be omitted.

Figure 5:
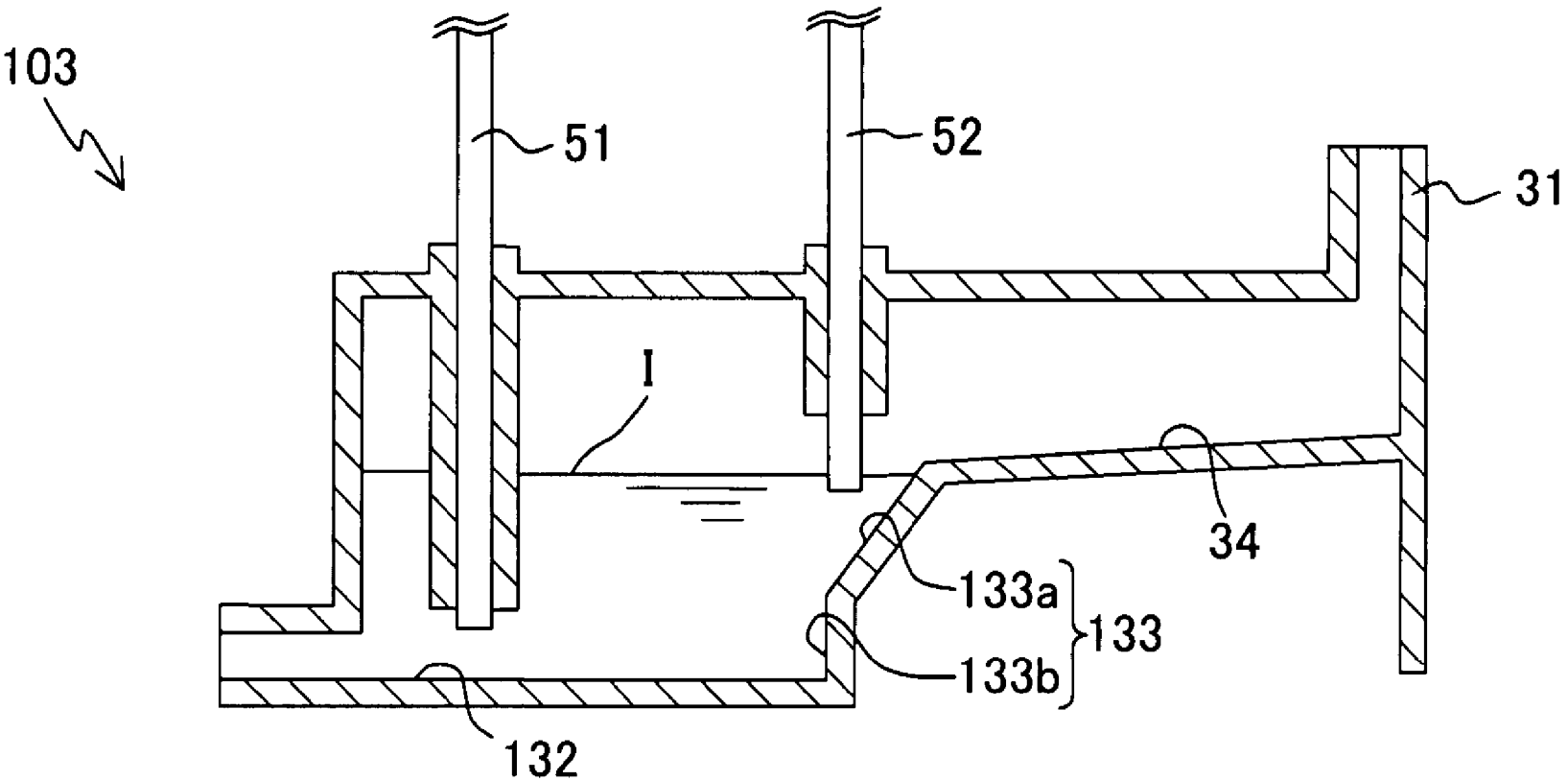
FIG. 5 shows a vertical sectional view illustrating a buffer tank in a second embodiment.

FIG. 5 shows a vertical sectional view illustrating the buffer tank 103 in the second embodiment. FIG. 5 is illustrated such that the ink cartridge 2, the supply tube 4 and the like are omitted. The buffer tank 103 is constructed so that the upright surface section 133 is provided with an inclined section 133*a* and a base section 133*b*. As shown in FIG. 5, the inclined section 133*a* is formed to incline downwardly from the upper step surface section 34 to the lower step surface section 132. Therefore, when the liquid surface level of the ink I is lowered along the inclined section 133*a*, it is possible to further quicken the lowering speed of the liquid surface level as compared with the case in which the upright surface section 33 is formed substantially perpendicularly from the position of intersection between the upright surface section 33 and the upper step surface section 34 as in the first embodiment. Therefore, it is possible to further suppress the erroneous judgment on the presence or absence of the ink.

When the inclined section 133*a* is extended to the position at which the inclined section 133*a* is opposed to the outside air-introducing tube 52, the liquid surface of the ink I can be also separated in the horizontal direction (leftward direction in FIG. 5) from the outside air-introducing tube 52 as the liquid surface is lowered. As a result, it is possible to further suppress the erroneous judgment which would be otherwise caused by the fluctuation of the ink liquid surface.

Next, a third embodiment will be explained with reference to FIGS. 6 and 7. A buffer tank 203 of the third embodiment is constructed such that the buffer tank 203 is comparted into upper and lower two chambers with a comparting member (comparting plate) 232, and thus the liquid surface area of the ink I is decreased. The same parts or components as those of the first embodiment described above are designated by the same reference numerals, any explanation of which will be omitted.

Figure 6:
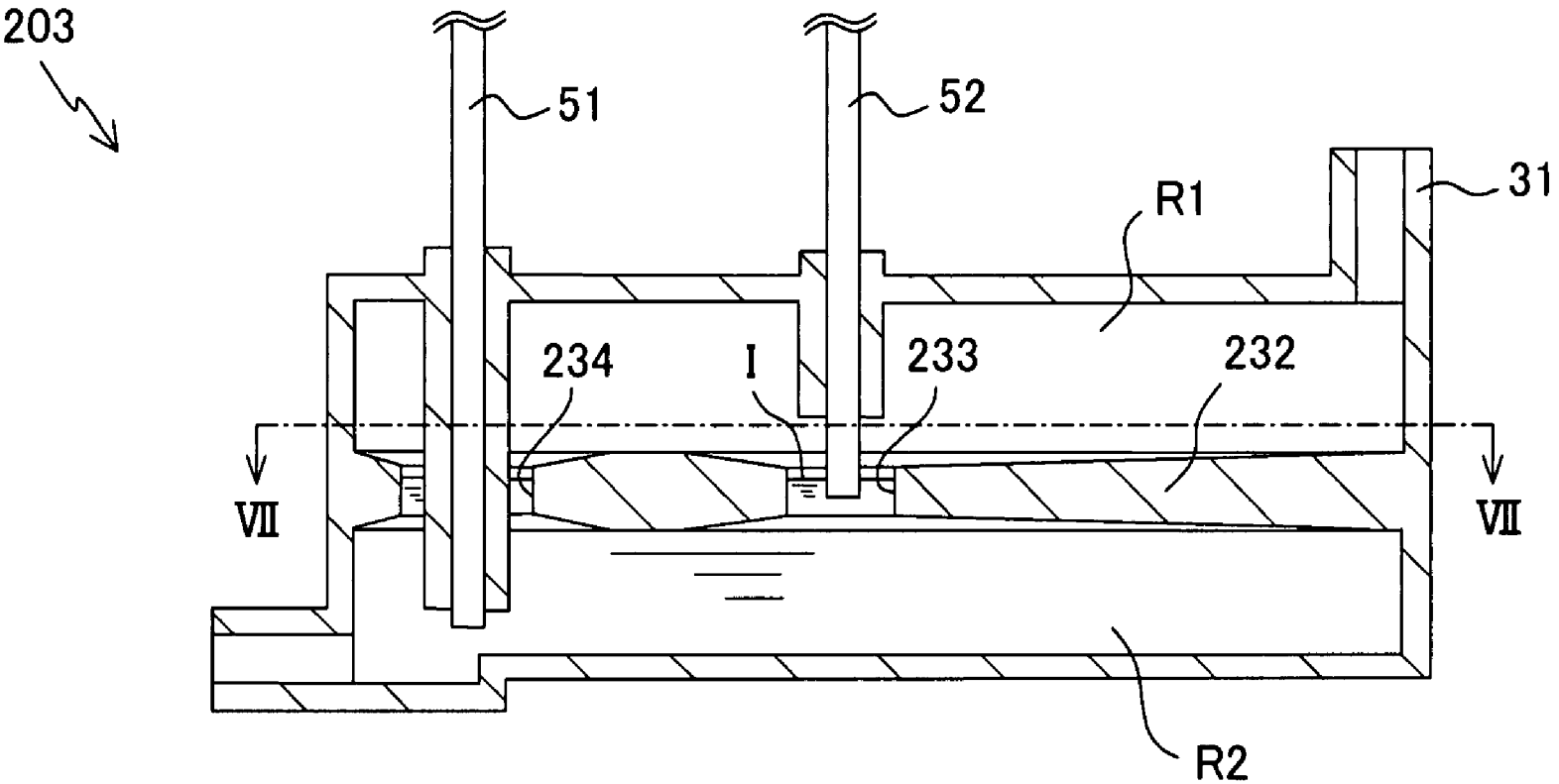
FIG. 6 shows a vertical sectional view illustrating a buffer tank in a third embodiment.
Figure 7:
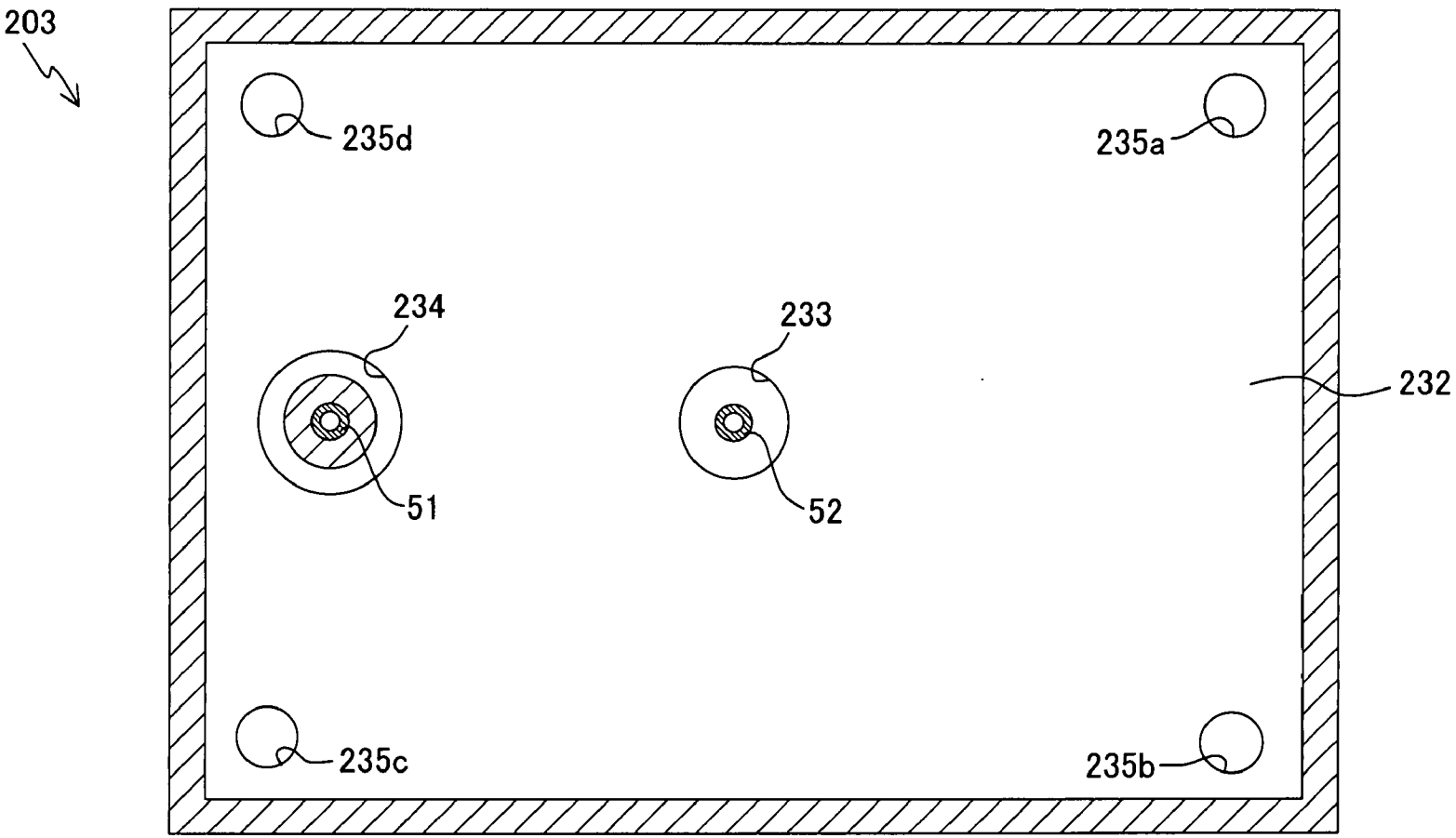
FIG. 7 shows a horizontal sectional view illustrating the buffer tank taken along a line VII—VII shown in FIG. 6.

FIG. 6 shows a vertical sectional view illustrating the buffer tank 203 of the third embodiment, and FIG. 7 shows a horizontal sectional view taken along a line VII—VII shown in FIG. 6 illustrating the buffer tank 203. The drawings are illustrated while omitting, for example, the ink cartridge 2 and the supply tube 4.

As shown in FIGS. 6 and 7, a comparting member 232, which has a predetermined thickness and which has a substantially rectangular shape as viewed in a top view, is arranged in buffer tank 203. The interior of the buffer tank 203 is comparted into upper and lower two chambers, i.e., a first chamber R1 and a second chamber R2 with the comparting member 232. Communication passages 233, 234, which make mutual communication between the first chamber and the second chamber, are provided penetratingly through the comparting member 232. The lower end opening of the ink-introducing tube 51 is open in the second chamber R2 while passing through the communication passage 234, and the lower end opening of the outside air-introducing tube 52 is open in the communication passage 233.

That is, the horizontal sectional area at a height approximately of the lower end opening of the outside air-introducing tube 52 in the internal space of the buffer tank 203 is smaller than the horizontal sectional area in the space disposed over the comparting member 232.

The inner circumferences of the communication passages 233, 234 are defined with gaps with respect to the outer circumferences of the respective introducing tubes 51, 52. The gaps make it possible to allow the outside air to flow. The communication passage 233, into which the lower end of the outside air-introducing tube 52 is inserted, is set and sized to have a diameter and a vertical length (i.e., the thickness of the comparting member 232) such that no ink makes contact with the lower end of the outside air-introducing tube 52 even when the liquid surface of the ink I is fluctuated within a predetermined range after the liquid surface of the ink I is separated by a predetermined amount from the lower end of the outside air-introducing tube 52 while the lower end of the outside air-introducing tube 52 is positioned in the communication passage 233, for example, due to the presence of any production error (error within an allowable range) in the outside air-introducing tube 52 and the comparting member 232. The outer diameter of the outside air-introducing tube 52 may be, for example, 1 to 1.5 mm, the inner diameter of the communication passage 233 may be, for example, 4 to 5 mm, and the thickness of the comparting member 232 may be, for example, 3 to 4 mm.

Therefore, in the steady state shown in FIG. 6, the liquid surface level of the ink I contained in the buffer tank 203 is maintained within the communication passages 233, 234. Therefore, it is possible to extremely decrease the liquid surface area of the ink I, and it is possible to suppress the evaporation of water from the ink liquid surface.

When the ink liquid surface in the buffer tank 203 is retained within the communication passages 233, 234 as described above, then the liquid surface area of the ink I can be decreased, and it is possible to extremely quicken the lowering speed of the liquid surface level. Accordingly, the height or level of the ink liquid surface is detected more sensitively. Therefore, the liquid surface of the ink I in the buffer tank 203 can be quickly separated from the outside air-introducing tube 52 after all of the ink contained in the ink cartridge 2 is consumed. Further, when the liquid surface is once lowered to the second chamber R2, it is possible that the liquid surface is hardly returned into the communication passages 233, 234. Therefore, it is possible to suppress the erroneous judgment on the presence or absence of the ink. In view of the suppression of the evaporation of water from the ink liquid surface and the sensitivity to the ink liquid surface height, it is preferable that the cross-sectional area of the surface parallel to the ink liquid surface of the communication passage is as small as possible. For example, the cross-sectional area may be not more than 10% and especially not more than 5% of the area of the comparting member 232.

Further, the space (second chamber R2), which has the sufficient volume, is secured under the comparting member 232, and the ink I can be sufficiently stored in the second chamber R2. Therefore, it is possible to provide a margin for the amount of data to be printed when the printing operation is further continued with the ink I contained in the buffer tank 203 while estimating the amount of consumption of the ink by using a soft counter or the like after the electric conduction is broken between the two introducing tubes 51, 52.

The liquid surface area of the ink I can be extremely decreased by comparing the interior of the buffer tank 203 with the comparting member 232. Further, it is possible to form the space (first chamber R1) having the sufficient volume over the ink liquid surface in the buffer tank 203 while suppressing the height dimension of the buffer tank 203 to be low as well. Therefore, the ink I, which is extruded from the ink cartridge 2, is reliably accommodated in the first chamber R1 in the buffer tank 203, and it is possible to suppress the overflow to the outside. The volume of the first chamber R1 is defined to ensure a volume of about 13% of the total volume of the ink cartridge 2.

As shown in FIG. 7, communication passages 235*a* to 235*d*, which make communication between the first chamber R1 and the second chamber R2, are provided at a plurality of (four in this embodiment) positions through the comparting member 232. Therefore, when the air contained in the ink cartridge 2 is expanded or contracted, for example, by any sudden temperature change, and the ink I contained in the buffer tank 203 is increased/decreased, then the ink I can be smoothly increased/decreased with the plurality of communication passages 235*a* to 235*d*, and it is possible to suppress the ink I from foaming. Therefore, it is possible to previously avoid the occurrence of any discharge failure which would be otherwise caused by bubbles caught in the printing head 5. The diameters of the respective communication passages 235*a* to 235*d* are smaller than the diameters of the communication passages 233, 234 described above to suppress the evaporation of water.

As shown in FIG. 7, the respective communication passages 235*a* to 235*d* are provided penetratingly through four corners of the comparting member 232 formed to have the substantially rectangular shape as viewed in a top view respectively. Therefore, for example, even when the ink-jet recording apparatus 1 is not installed horizontally, and the ink liquid surface in the buffer tank 203 is inclined, then it is possible to suppress the remaining of bubbles at one corner in the second chamber R2 (on the lower surface side of the comparting member 232) when the amount of the ink I in the buffer tank 203 is increased, and it is possible to suppress the remaining of the ink I at one corner in the first chamber R1 (on the upper surface side of the comparting member 232) when the amount of the ink I in the buffer tank 203 is decreased.

The portions of the surface of the comparting member 232 on the side of the first chamber R1, which are disposed in the vicinity of the portions for providing the respective communication passages 233, 234, 235*a* to 235*d* therethrough, are inclined downwardly toward the respective communication passages 233, 234, 235*a* to 235*d*. On the other hand, the portions of the surface of the comparting member 232 on the side of the second chamber R2, which are disposed in the vicinity of the portions for providing the respective communication passages 233, 234, 235*a* to 235*d* therethrough, are inclined upwardly toward the respective communication passages 233, 234, 235*a* to 235*d*. Therefore, it is possible to allow the ink to flow downwardly along the inclined portions, or it is possible to raise the bubbles along the inclined portions. Therefore, it is possible to suppress the remaining of the ink on the upper surface side of the comparting member 232, and it is possible to suppress the remaining of the bubbles on the lower surface side of the comparting member 232.

The present invention has been explained above on the basis of the embodiments. However, the present invention is not limited to the embodiments described above at all. It is easy to appreciate that various improvements and modifications can be made within a range without deviating from the gist or essential characteristics of the present invention.

What is claimed is:

1. An ink-jet recording apparatus comprising:

a printing head which has an ink discharge port for discharging an ink;

an ink container which stores the ink; and a buffer tank which stores the ink to be supplied to the printing head and which has an outside air-connecting passage for connecting an upper space of the buffer tank to outside air, an ink-introducing tube having an open end in the buffer tank for introducing the ink into the buffer tank from the ink container through the open end, and an outside air-introducing tube having an open end in the buffer tank for introducing the outside air into the ink container through the open end, wherein:

the open end of the outside air-introducing tube is positioned at a height position higher than that of the open end of the ink-introducing tube, and a horizontal cross-sectional area in the buffer tank at the height position of the open end of the outside air-introducing tube is smaller than horizontal cross-sectional areas in the buffer tank at higher positions than the height position, and a bottom of the buffer tank is formed to have a substantially one-stepped structure as viewed in a vertical sectional view.

2. The ink-jet recording apparatus according to claim 1, wherein each of the ink-introducing tube and the outside air-introducing tube is composed of a conductive material, and the ink-introducing tube and the outside air-introducing tube are arranged to make contact with the ink stored in the buffer tank.

3. The ink-jet recording apparatus according to claim 1, wherein an upper step of the stepped structure is located at a position equal to or higher than the height position of the open end of the outside air-introducing tube.

4. The ink-jet recording apparatus according to claim 3, wherein a surface, which defines the upper step of the stepped structure, is inclined downwardly toward a lower step of the stepped structure.

5. The ink-jet recording apparatus according to claim 3, wherein at least a part of an upright section for making communication between the upper step and a lower step of the stepped structure is inclined to have an inclined portion thereof at which the horizontal cross-sectional area in the buffer tank is gradually decreased at downward positions.

6. The ink-jet recording apparatus according to claim 5, wherein the upright section is formed such that a lower step side of the upright section has a substantially right angle or a steep angle of inclination as compared with an upper step side of the upright section.

7. The ink-jet recording apparatus according to claim 1, wherein a space, which is located over a horizontal surface of the open end of the outside air-introducing tube, has a volume which is not less than 10% of a total volume of the ink container.

8. The ink-jet recording apparatus according to claim 1, wherein ends of the ink-introducing tube and the outside air-introducing tube, which are disposed on a side opposite to the open ends, are hollow needle-shaped respectively.

9. An ink-jet recording apparatus comprising:

a printing head which has an ink discharge port for discharging an ink;

an ink container which stores the ink; and a buffer tank which stores the ink to be supplied to the printing head and which has a comparting plate for comparting the buffer tank into a first chamber and a second chamber, an outside air-connecting passage for connecting interior of the buffer tank to outside air, an ink-introducing tube provided penetratingly through the comparting plate for introducing the ink into the buffer tank from the ink container, and an outside air-introducing tube for introducing the outside air introduced into the buffer tank through the outside air-connecting passage into the ink container, wherein:

a communication passage, which makes communication between the first chamber and the second chamber, is formed through the comparting plate, and an open end of the outside air-introducing tube is positioned in the communication passage.

10. The ink-jet recording apparatus according to claim 9, wherein the communication passage includes at least first to third passages, the open end of the outside air-introducing tube is positioned in the first passage, and the ink-introducing tube penetrates through the second passage.

11. The ink-jet recording apparatus according to claim 10, wherein a cross-sectional area of the third passage is smaller than cross-sectional areas of the first and second passages.

12. The ink-jet recording apparatus according to claim 9, wherein a cross-sectional area of the first passage is not more than 10% of an area of the comparting plate.

13. The ink-jet recording apparatus according to claim 10, wherein the comparting plate is substantially rectangular as viewed in a top view, and the third passage is provided penetratingly through at least one of four corners of the comparting plate.

14. The ink-jet recording apparatus according to claim 9, wherein a portion of a surface of the comparting plate on a side of the first chamber, which is disposed in the vicinity of a portion in which the communication passage is provided therethrough, is formed to incline downwardly toward the communication passage.

15. The ink-jet recording apparatus according to claim 9, wherein a portion of a surface of the comparting plate on a side of the second chamber, which is disposed in the vicinity of a portion in which the communication passage is provided therethrough, is formed to incline upwardly toward the communication passage.

16. The ink-jet recording apparatus according to claim 9, wherein the first chamber has a volume which is not less than 10% of a total volume of the ink container.

17. The ink-jet recording apparatus according to claim 9, wherein ends of the ink-introducing tube and the outside air-introducing tube, which are disposed on a side opposite to the open ends, are hollow needle-shaped respectively.

* * * * *